US011445842B1

(12) United States Patent
Harshbarger

(10) Patent No.: US 11,445,842 B1
(45) Date of Patent: Sep. 20, 2022

(54) DEVICE AND METHOD FOR CLOSET ORGANIZATION

(71) Applicant: By A Girl, LLC, Los Angeles, CA (US)

(72) Inventor: Kara Harshbarger, Los Angeles, CA (US)

(73) Assignee: By a Girl, LLC, Los Angeles, CA (US)

( * ) Notice: Subject to any disclaimer, the term of this patent is extended or adjusted under 35 U.S.C. 154(b) by 0 days.

(21) Appl. No.: 17/307,334

(22) Filed: May 4, 2021

(51) Int. Cl.
*A47G 25/14* (2006.01)

(52) U.S. Cl.
CPC ..... *A47G 25/1471* (2013.01); *A47G 25/1407* (2013.01)

(58) Field of Classification Search
CPC ..... A47G 25/1471; A47G 25/1407; A47G 25/005; A47G 25/0607; A47G 25/0692; A47G 25/08; A47G 25/1421; A47G 25/1442; A47G 25/145; A47G 25/1457; A47G 25/28; A47G 25/32; A47G 25/34; G09F 3/0295; G09F 3/205; G09F 7/18
USPC ..... 211/123, 124; 223/85; 40/617, 660, 40/642.01, 322, 396, 666; 248/340, 304, 248/690, 692, 227.1, 227.4
See application file for complete search history.

(56) References Cited

U.S. PATENT DOCUMENTS 1,321,926 A * 11/1919 Landry ..... A47G 25/1407 40/322
1,422,973 A * 7/1922 Hertzberg ..... G09F 3/14 40/659
1,424,573 A * 8/1922 Larson ..... F21V 35/00 D26/21
1,634,377 A * 7/1927 Montan ..... A47G 25/1421 40/322
2,058,963 A * 10/1936 Drummond ..... A47G 29/10 40/657
2,074,841 A * 3/1937 Haimowitz ..... A47G 25/1421 40/658
2,288,071 A * 6/1942 Cohen ..... A47G 25/1421 40/658
2,543,350 A * 2/1951 Bross ..... A47G 25/1421 40/322
2,705,385 A * 4/1955 Markward ..... A47K 5/02 248/214
2,917,181 A * 12/1959 Staub ..... B65G 1/02 211/124

(Continued)

*Primary Examiner* — Jennifer E. Novosad
(74) *Attorney, Agent, or Firm* — NK Patent Law

(57) ABSTRACT

A divider device for organizing hanging clothing into groups by dividing space along a clothing rod into respective sections includes: a circularly arcuate clip having a terminal distal end and a proximal end, the clip defining a circularly arcuate internal contact surface for engaging a clothing rod and a gap between the distal end and the proximal end for permitting a clothing rod to pass therethrough by flexure of the clip when mounting the clip on a clothing rod, the internal contact surface being interrupted by at least the gap and thereby incompletely encircling a central axis of the circularly arcuate internal contact surface; and a planar presentation plate connected to the proximal end of the clip, the presentation plate being offset from the central axis and having a planar front face perpendicular to the central axis.

16 Claims, 6 Drawing Sheets

(56) References Cited

U.S. PATENT DOCUMENTS 3,024,953 A * 3/1962 O'Keefe ..... A47G 25/1421 40/322
3,568,852 A * 3/1971 Howard ..... A47F 7/163 211/124
3,618,176 A * 11/1971 Barnes ..... A47F 5/0853 52/39
3,620,376 A * 11/1971 Gingher ..... A47G 25/0692 248/300
3,633,801 A * 1/1972 Bonasso ..... A47G 25/1457 294/142
3,685,189 A * 8/1972 Conger ..... A47G 25/50 40/322
3,731,809 A * 5/1973 Saenger ..... A47G 25/1457 294/143
3,792,804 A * 2/1974 Ponzo ..... A47G 25/32 211/113
3,880,280 A * 4/1975 Fyvolent ..... A47F 7/19 248/123.2
4,023,762 A * 5/1977 Batts ..... A47G 25/005 D9/434
4,037,728 A * 7/1977 Cameron ..... A47G 25/1457 211/124
4,296,959 A * 10/1981 Helbig ..... A47G 25/1457 294/169
D264,904 S * 6/1982 Helbig ..... D6/315
4,333,590 A * 6/1982 Princiotta ..... A47G 25/1471 40/322
4,335,839 A * 6/1982 Kessler ..... A45F 5/102 294/142
4,340,145 A * 7/1982 Cameron ..... A47G 25/0692 211/124
4,415,093 A * 11/1983 Livingston ..... A47G 25/0692 211/113
4,557,516 A * 12/1985 Usner ..... A47G 25/1457 294/143
4,762,238 A * 8/1988 Blanchard ..... A47G 25/0692 223/85
4,768,649 A * 9/1988 Kolton ..... A47G 25/743 211/113
4,802,265 A * 2/1989 Stevenson ..... A47G 25/485 211/124
4,971,279 A * 11/1990 George ..... A47G 1/1686 248/214
4,993,126 A * 2/1991 Collins ..... D06F 55/00 24/336
5,018,627 A * 5/1991 Moore ..... A47G 25/0692 206/291
5,174,537 A * 12/1992 Mazzorato ..... A47G 25/1421 248/340
5,273,334 A * 12/1993 Schopfer ..... A47G 25/1457 294/167
5,381,938 A * 1/1995 Vasudeva ..... A47G 25/1407 40/322
5,415,299 A * 5/1995 Usner ..... B65G 9/008 224/313
5,492,295 A * 2/1996 Remmers ..... A47F 5/14 248/251
5,524,948 A * 6/1996 Bostwick ..... A47G 25/1457 294/142
5,531,416 A * 7/1996 Remmers ..... A47G 25/0692 248/222.51
5,584,455 A * 12/1996 Artemi ..... A47G 25/1457 211/113
5,697,508 A * 12/1997 Rifkin ..... B65G 9/002 211/124
5,758,851 A * 6/1998 Remmers ..... A47B 96/061 248/222.51
D414,967 S * 10/1999 Richter ..... D12/416
6,167,914 B1 * 1/2001 Koteskey ..... E21B 43/086 138/156
6,182,871 B1 * 2/2001 Lam ..... A47G 25/1407 223/120
6,289,569 B1 * 9/2001 Marshall ..... G09F 3/20 29/700
6,299,039 B1 * 10/2001 Hsu ..... A47G 25/1407 223/87
6,488,159 B2 * 12/2002 Shuen ..... A47G 25/0692 211/105.3
6,719,156 B2 * 4/2004 Ellbogen ..... A47H 1/10 248/161
6,886,796 B1 * 5/2005 Elander ..... A47F 5/0006 248/339
7,134,561 B2 * 11/2006 Schneider ..... A47G 25/1457 211/124
D536,539 S * 2/2007 Chen ..... D6/328
7,464,910 B1 * 12/2008 St. Germain ..... G10G 5/00 211/85.6
7,516,930 B2 * 4/2009 Chen ..... F16B 7/0433 248/304
7,568,673 B2 * 8/2009 Evingson ..... A45F 3/20 248/220.21
7,641,356 B2 * 1/2010 Pieroth ..... F21V 21/0885 248/339
7,703,735 B2 * 4/2010 Fryer ..... A47F 5/0006 24/372
D624,759 S * 10/2010 Jacobson ..... A47G 25/0692 D6/323
8,016,138 B2 * 9/2011 Jacobson ..... A47F 5/0838 211/124
8,998,044 B1 * 4/2015 Perrin ..... A47G 25/1471 223/85
9,080,715 B2 * 7/2015 Biddle ..... A47G 29/083
10,070,745 B2 * 9/2018 Blevins ..... A47G 25/0607
10,299,615 B1 * 5/2019 Donegan ..... A47G 25/1471
10,827,864 B2 * 11/2020 Ronk ..... A47B 61/06
2003/0106974 A1 * 6/2003 Guertin ..... B62J 11/04 248/230.5
2003/0192846 A1 * 10/2003 White ..... A47G 25/1421 223/85
2005/0173475 A1 * 8/2005 Murphy, Jr. ..... A47G 25/20 223/85
2006/0006301 A1 * 1/2006 Turi ..... G09F 23/00 248/304
2007/0228089 A1 * 10/2007 Mainetti ..... A47G 25/1421 223/85
2010/0270338 A1 * 10/2010 Mainetti ..... A47G 25/1407 40/322
2011/0220691 A1 * 9/2011 Kahn ..... A47G 25/36 223/87
2012/0145661 A1 * 6/2012 Fernandez ..... A47B 96/06 248/251
2012/0198680 A1 * 8/2012 Durben ..... F21S 4/10 248/220.21
2013/0082017 A1 * 4/2013 Tang ..... A47H 13/01 211/124
2013/0244031 A1 * 9/2013 Ghiorghie ..... A47G 29/10 428/369
2015/0144277 A1 * 5/2015 Courvisier ..... F16B 5/0692 248/339
2016/0029825 A1 * 2/2016 Perrin ..... F16B 2/10 52/27
2020/0281374 A1 * 9/2020 Madueke ..... A45C 11/00

* cited by examiner

DEVICE AND METHOD FOR CLOSET ORGANIZATION

TECHNICAL FIELD

The present disclosure relates to organizational devices. More particularly, the present disclosure relates to devices and methods for organizing hanging garments into groups by dividing space along a clothing rod into respective sections.

BACKGROUND

Given the popularity of home improvement shows, books, and blogs, and particularly media directed toward home organization, the demand for organizing products cannot be understated. The places in the home most likely to be unorganized may be the closets, particularly clothing closets. Typical closet rod dividers on the market are hidden low, generally hanging below the closet rod among clothes with writing on the side making it impossible to see the indicated category and defeating the purpose.

Improved organization devices and methods are needed.

SUMMARY

This summary is provided to briefly introduce concepts that are further described in the following detailed descriptions. This summary is not intended to identify key features or essential features of the claimed subject matter, nor is it to be construed as limiting the scope of the claimed subject matter.

According to at least one embodiment, a divider device for organizing hanging clothing items into groups by dividing space along a clothing rod into respective sections, the divider including: a circularly arcuate clip having a terminal distal end and a proximal end, the clip defining a circularly arcuate internal contact surface for engaging a clothing rod and a gap between the distal end and the proximal end for permitting a clothing rod to pass therethrough by flexure of the clip when mounting the clip on a clothing rod, the internal contact surface being interrupted by at least the gap and thereby incompletely encircling a central axis of the circularly arcuate internal contact surface; and a planar presentation plate connected to the proximal end of the clip, the presentation plate being offset from the central axis and having a planar front face perpendicular to the central axis.

The presentation plate may be connected to the proximal end of the clip by an extension piece that supports the presentation plate when mounted on the clothing rod.

The presentation plate may be offset from the central axis to be forward and elevated relative to a closet rod when mounted on the clothing rod.

The clip further may further include an expansion joint by which the clip is configured to accommodate a range of clothing rod diameters.

The expansion joint may connect a circularly arcuate proximal section of the clip to a circularly arcuate distal section.

The proximal section of the clip and the distal section of the clip may each define a respective portion of the internal contact surface of the clip.

The expansion joint may include a first arm connected to the proximal section of the clip, a second arm connected to the distal section of the clip, and an elbow that connects the second arm to the first arm.

The clip, the extension piece, and the presentation plate may be materially contiguous.

The presentation plate may include a front face that includes at least one of graphical indicia and text, the at least one of graphical indicia and text indicating a category of clothing items.

Multiple adhesive-backed labels may be provided for user-selectively adhering to the presentation plate, each of the labels including at least one of graphical indicia and text, the at least one of graphical indicia and text of each label indicating a respective category of clothing items.

According to at least one embodiment, a method of organizing hanging clothing items into groups by dividing space along a clothing rod into respective sections includes: mounting multiple divider devices on a clothing rod and spaced along the clothing rod; and hanging clothing items in clothing category groups, each group adjacent a particular respective one of the multiple divider devices. Each said divider device includes: a circularly arcuate clip having a terminal distal end and a proximal end, the clip defining arcuate internal contact surface engaging the clothing rod and a gap between the distal end and the proximal end, the internal contact surface being interrupted by at least the gap and thereby incompletely encircling the closet rod; and a presentation plate connected to the proximal end of the clip, the presentation plate being offset from the closet rod and having a front face perpendicular to a longitudinal axis of the closet rod.

The front face of the presentation plate of each particular divider device may include at least one of graphical indicia and text, the at least one of graphical indicia and text indicating the clothing category of the clothing category group adjacent the particular divider device.

Mounting multiple divider devices on the clothing rod may include forcing the clip of each divider device onto the clothing rod by passing the closet rod through the gap of the clip.

Forcing the clip of each divider device onto the clothing rod may include temporarily flexibly deforming the clip to pass the clothing rod through the gap until the clip snaps into engagement as the rod passes through the gap, and the clip returning toward an un-flexed condition.

The clip may further include an expansion joint, and flexibly deforming the clip to pass the clothing rod through the gap may include temporarily expanding the expansion joint.

The above summary is to be understood as cumulative and inclusive. The above described embodiments and features are combined in various combinations in whole or in part in one or more other embodiments.

BRIEF DESCRIPTION OF THE DRAWINGS

The previous summary and the following detailed descriptions are to be read in view of the drawings, which illustrate particular exemplary embodiments and features as briefly described below. The summary and detailed descriptions, however, are not limited to only those embodiments and features explicitly illustrated.

DETAILED DESCRIPTIONS

Figure 1:
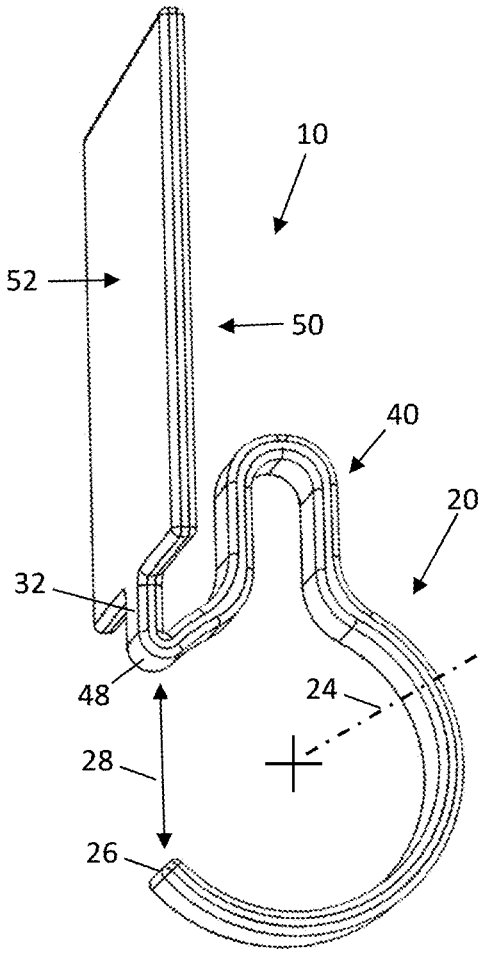
FIG. 1 is a perspective view of a divider device according to at least one embodiment.

These descriptions are presented with sufficient details to provide an understanding of one or more particular embodiments of broader inventive subject matters. These descriptions expound upon and exemplify particular features of those particular embodiments without limiting the inventive subject matters to the explicitly described embodiments and features. Considerations in view of these descriptions will likely give rise to additional and similar embodiments and features without departing from the scope of the inventive subject matters. Although steps may be expressly described or implied relating to features of processes or methods, no implication is made of any particular order or sequence among such expressed or implied steps unless an order or sequence is explicitly stated.

Any dimensions expressed or implied in the drawings and these descriptions are provided for exemplary purposes. Thus, not all embodiments within the scope of the drawings and these descriptions are made according to such exemplary dimensions. The drawings are not made necessarily to scale. Thus, not all embodiments within the scope of the drawings and these descriptions are made according to the apparent scale of the drawings with regard to relative dimensions in the drawings. However, for each drawing, at least one embodiment is made according to the apparent relative scale of the drawing.

Like reference numbers used throughout the drawings depict like or similar elements. Unless described or implied as exclusive alternatives, features throughout the drawings and descriptions should be taken as cumulative, such that features expressly associated with some particular embodiments can be combined with other embodiments.

A divider device 10, according to at least one embodiment, is shown in FIG. 1. The divider device 10 is particularly advantageous for organizing hanging garments into groups by dividing available clothing rod space into respective sections. Other uses and advantages may come to mind in view of the drawings and these descriptions.

Figure 2:
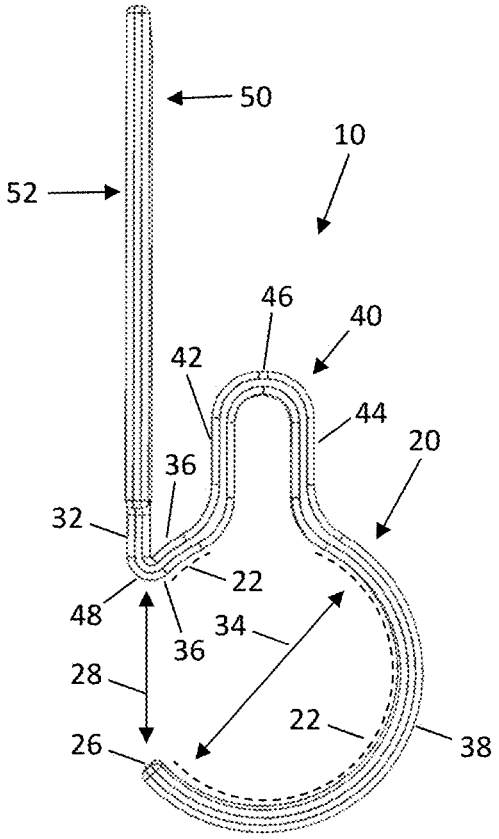
FIG. 2 is a side view of the divider device of FIG. 1.
Figure 3:
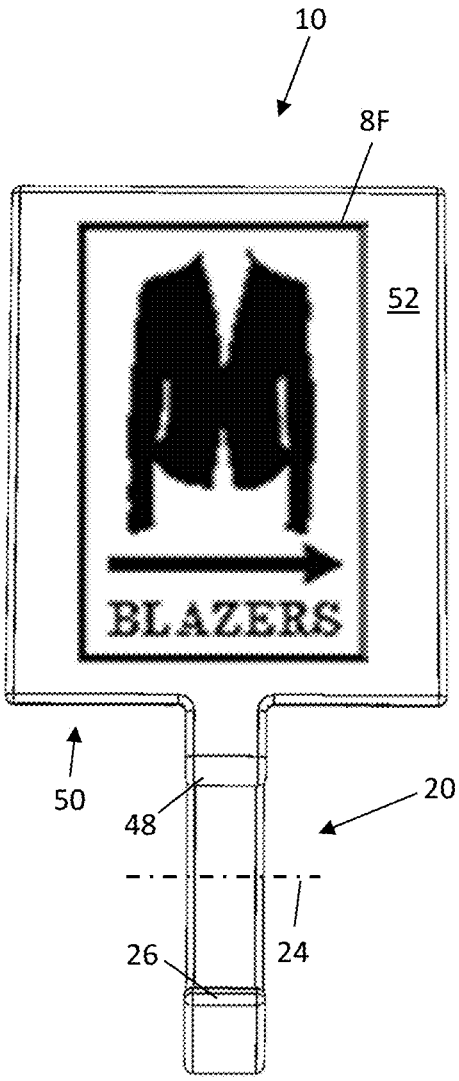
FIG. 3 is a front view of the divider device of FIG. 1, shown with the exemplary label of FIG. 8F.
Figure 4:
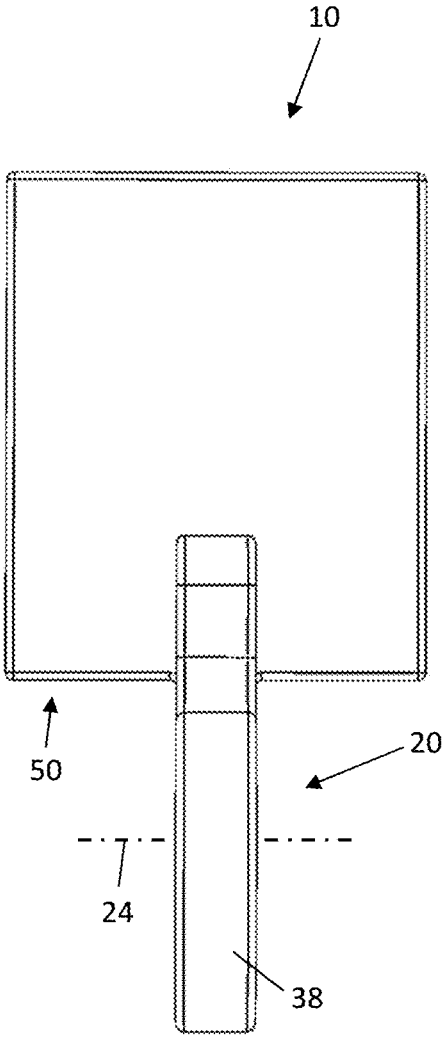
FIG. 4 is a back view of the divider device of FIG. 1.
Figure 5:
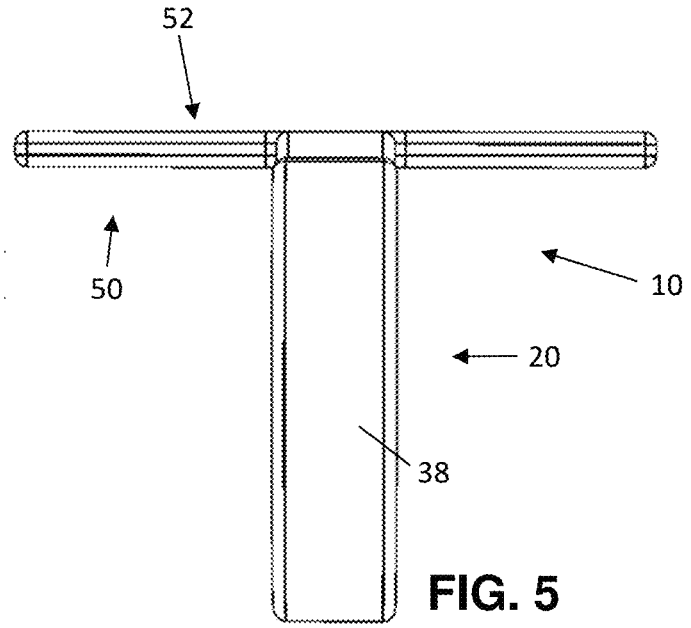
FIG. 5 is a bottom view of the divider device of FIG. 1.
Figure 6:
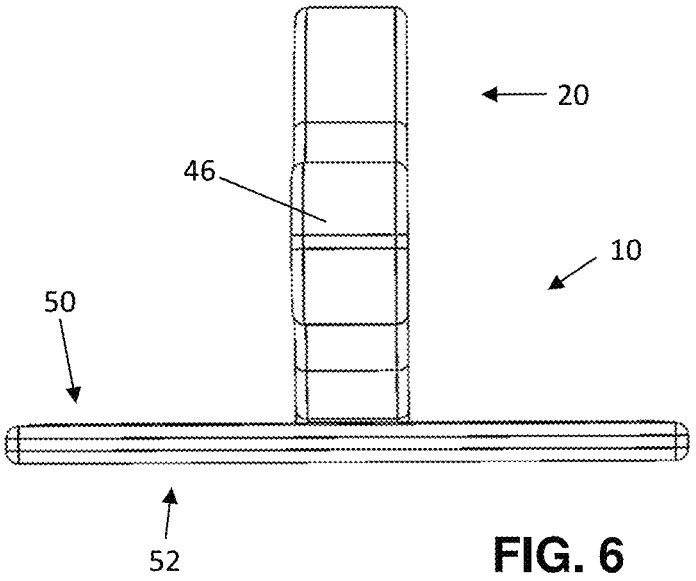
FIG. 6 is a bottom view of the divider device of FIG. 1.

FIG. 2 is a first side view of the divider device 10. The second side opposite the first is not expressly shown in the drawings, but would appear as a mirror image of that shown in FIG. 2, thus having a shape and appearance that would be evident from the one shown in FIG. 1. The divider device 10 has an arcuate clip 20 for mounting upon a rod between clothing groups as preferred by a user. Such rods are typically fixed as horizontal within a closet or upon a mobile clothing rack. The clip 20 has an internal contact surface 22 that engages rod in a snap-on engagement. The contact surface 22 is emphasized by dashed line in FIG. 2 for illustration. In the un-flexed condition as shown in FIGS. 1-7, the clip 20 and internal contact surface 22 are generally circularly arcuate. The clip 20 is sized in various embodiments to mount upon and frictionally engage a rod having a particular diameter or diameter range. For example, some standard clothing rods are sized as having 1 inch diameters, 1-¼ (1.25) inch diameters, 1-5⁄16 (1.31) in diameters, 1-⅜ (1.375) inch diameters, and 1-½ (1.5) inch diameters.

A central axis 24 (FIGS. 1, 3-4) of the clip 20 extends through the center of the circular arc of the contact surface 22. A planar presentation plate 50 of the divider device 10 is offset from the central axis 24, and has a planar front face 52, which is perpendicular to the central axis 24. The clip 20 and internal contact surface 22 thereof, only partially surround (incompletely encircle) the central axis 24, each interrupted at least, in the illustrated embodiment, by the gap 28 as described in the following and shown in FIG. 1.

Figure 7:
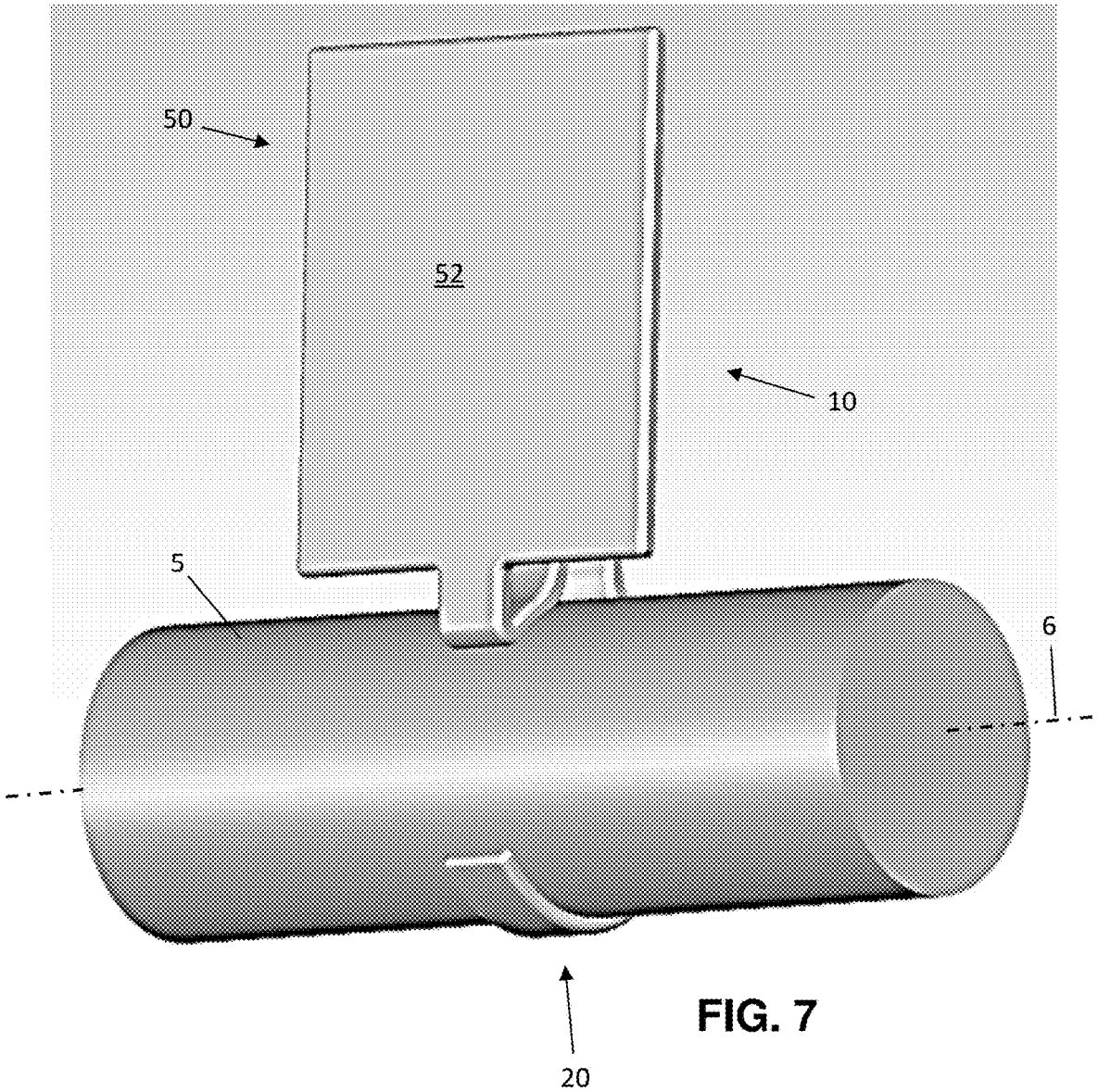
FIG. 7 is perspective view of the divider of FIG. 1 mounted on a clothing rod.
Figure 8A:
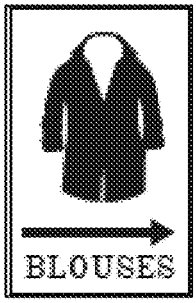
FIG. 8A shows an exemplary label indicating blouses.
Figure 8B:
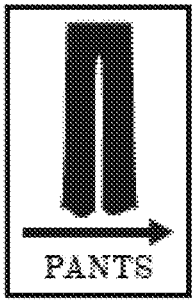
FIG. 8B shows an exemplary label indicating pants.
Figure 8C:
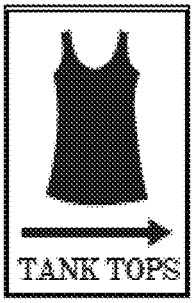
FIG. 8C shows an exemplary label indicating tank tops.
Figure 8D:
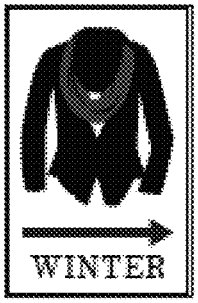
FIG. 8D shows an exemplary label indicating winter clothing items.
Figure 8E:
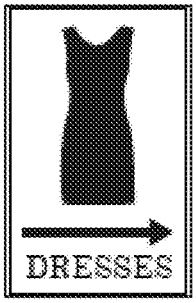
FIG. 8E shows an exemplary label indicating dresses.
Figure 8F:
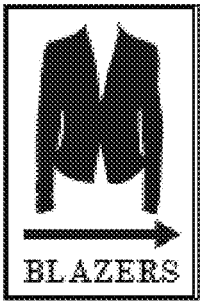
FIG. 8F shows an exemplary label indicating blazers.
Figure 8G:
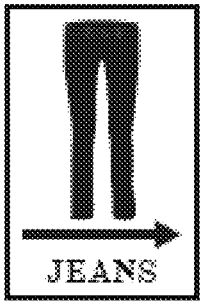
FIG. 8G shows an exemplary label indicating jeans.
Figure 8H:
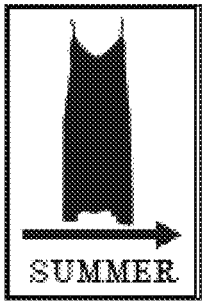
FIG. 8H shows an exemplary label indicating summer clothing items.
Figure 8J:
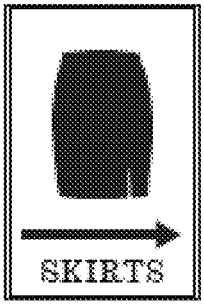
FIG. 8J shows an exemplary label indicating skirts.
Figure 8K:
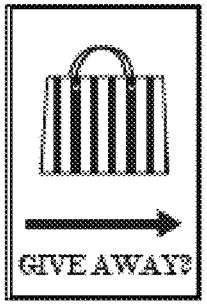
FIG. 8K shows an exemplary label indicating giveaway clothing items.

Upon mounting the clip 20 on a clothing rod 5, the central axis 24 is parallel to, and coincident with, the longitudinal axis 6 (FIG. 7) of the rod 5. When the divider device 10 is mounted on a rod 5 in an expected orientation, the presentation plate 50 is raised relative to the rod 5, and as perpendicular to central axis 24 (FIG. 1) and to the longitudinal axis 6 of the rod 5 of the as shown in FIG. 7. The front face 52 is thus directed forward toward a user. This advantageously arranges the presentation plate 50 as vertical and optimizes the visibility of the presentation plate 50 and front face 52 thereof among hanging items on the rod 5 such as clothing groups as sorted by a user according to their preferences. Users may find other orientations to their liking. For example, a user may prefer the presentation plate 50 to hang below a rod. Thus, the expected orientation described herein and illustrated in FIG. 7 is nominal and non-limiting.

The clip 20 is formed as a circular segment having a terminal distal end 26 and a proximal end 30, with respect to the presentation plate 50. A gap 28 (FIG. 2) is defined between the distal end 26 and proximal end 30 for passage of a clothing rod. The presentation plate 50 is connected to the clip 20 by an extension piece 32 that supports the presentation plate 50 as offset from the central axis 24 to be slightly forward and elevated relative to a closet rod 5 in use in the expected orientation with the presentation plate arranged as generally vertical as shown in FIG. 7.

The clip 20 is made of a flexibly semi-rigid and resilient and durable material capable of flexing to permit a closet rod to pass through the gap 28, which is sized as less than the diameter of a closet rod on which any given example of the divider device 10 is sized and intended to mount upon. For example, the clip 20, extension piece 32, and presentation plate 50 can be made as a unitary and materially contiguous plastic item by injection molding. To mount the divider device 10 on a clothing rod, the clip 20 is gently forced by a user onto the rod via the gap 28, temporarily flexibly deforming the clip 20 and expanding the expansion joint. The clip 20 snaps into engagement as the rod passes through the gap 28, returning toward its un-flexed condition (shown in all FIGS.). The divider device 10 is to be rotated if needed on the rod to extend the presentation plate 50 forward and elevated relative to the rod to reach the expected orientation if preferred. The arcuate internal contact surface 22 of the clip 20 frictionally engages a rod of its intended use and size (diameter) range. An adhesive padding may be included and applied to the internal contact surface 22 to increase frictional engagement and/or accommodate a smaller rod by decreasing the effective internal diameter 34 (FIG. 2) of the clip 20.

In the illustrated embodiment, the clip 20 includes an expansion joint 40 that separates the clip 20 into a circularly arcuate proximal section 36 and a circularly arcuate distal section 38, with respect to the presentation plate 50. The proximal section 36 and distal section 38 accordingly define respective portions of the internal contact surface 22 as shown in FIG. 2. The distal section 38 is connected to the proximal section 36 by way of the expansion joint 40.

The expansion joint 40 is shown in the drawings as having a first linear arm 42 connected to the proximal section 36, and a second linear arm 44 connected to the distal section 38. The second linear arm 44 is parallel to the first linear arm 43 in the un-flexed condition of the clip 20 shown in the drawings. An elbow 46 connects the second linear arm 44 to the first linear arm 42, defining a 180 degree turn joint in a U-shaped configuration in the un-flexed condition of the clip 20 shown in the drawings. The expansion joint 40 advantageously permits the use of a single clip 20 size to accommodate a wide range of clothing rod diameters, for example 1 inch to 1-½ (1.5) inch diameters.

In the illustrated embodiment, the expansion joint 40 and other portions of the clip 20 are materially contiguous, resilient and durable so as to flex to permit a closet rod to pass through the gap 28 (FIG. 2) when gently forced by a user such that the clip 20 snaps into engagement as the rod passes through the gap, and returns toward its un-flexed condition (shown in all FIGS.) thereby engaging and gripping the rod.

The proximal end 30 of the clip 20 is connected to the extension piece 32 by a rounded junction 48, and the terminal distal end 26 of the clip 20 is beveled or rounded. These features advantageously guide a clothing rod into the clip 20 as the clip flexes when being mounted.

The front face 52 of the presentation plate 50 may include graphical indicia or text, which may be pre-applied or applied by a user according to user preferences to indicate a category of items associated with any particular divider device 10. For example, clothing categories such as pants, shirts, skirts, blazers, and others may be indicated on the front faces 52 of respective divider devices 10. For example, multiple divider devices 10 may be provided to consumers and retailers together with adhesive-backed labels (stickers) each indicating an item category. Non-limiting examples are shown FIGS. 8A-8K. Arrows in illustrated label examples refer directionally to the item category they indicate to unambiguously direct a user's attention left or right along a clothing rod to hang and find category items. For example, stickers may be provided to indicate popular clothing categories and aspirational images. Blank stickers may be provided for customization.

The presentation plate 50 is illustrated as generally rectangular. The exemplary labels (FIGS. 8A-8K) are also correspondingly illustrated as rectangular. Other shapes are within the scope of these descriptions, even those that don't corresponding match between the presentation plate 50 and labels. The presentation plates 50 and labels may be provided to consumers and businesses in groups or separately. The labels may be applied by purchasers or they may be pre-applied. The labels may be adhesive-backed (stickers) as already described, or they may be pre-applied as printing or other coloration on the front faces 52 of the presentation plates 50.

Figure 9:
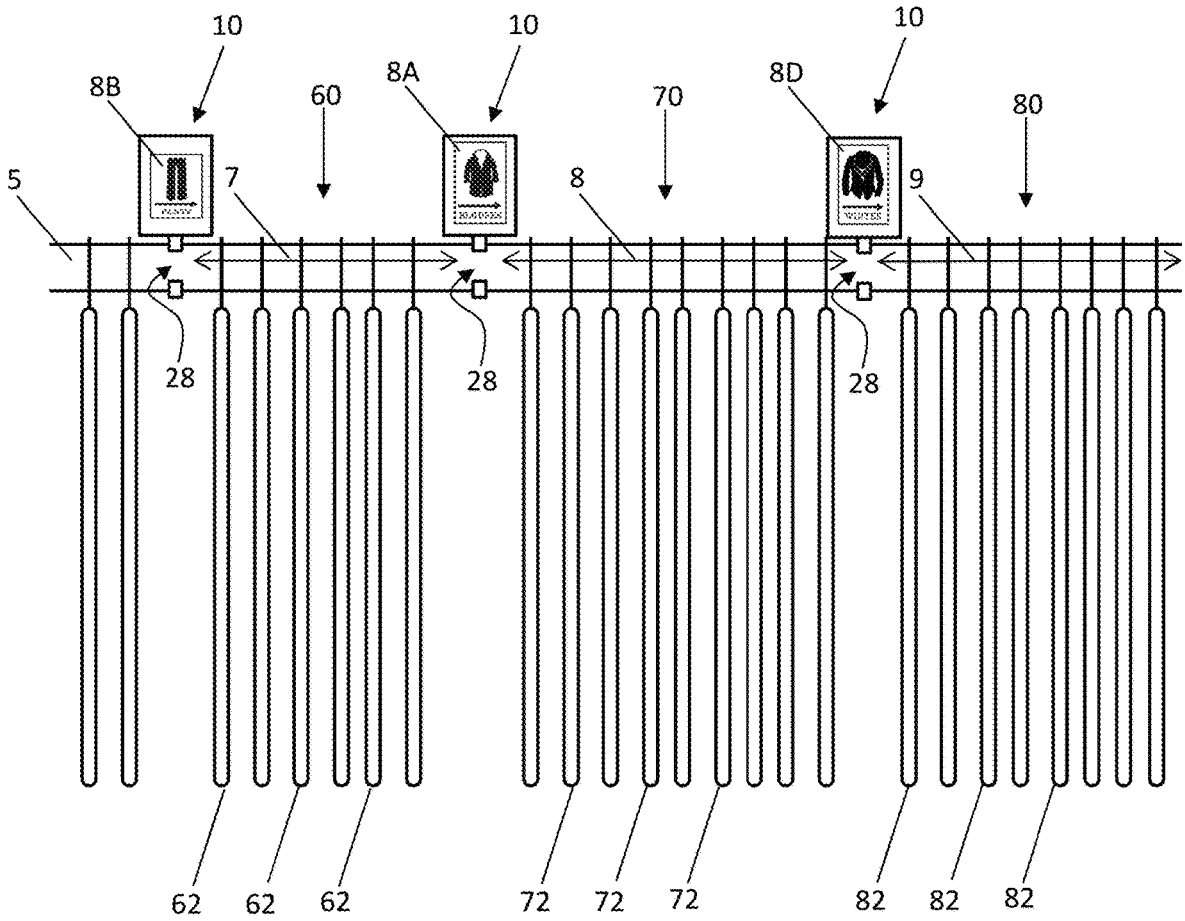
FIG. 9 shows an exemplary organized arrangement of clothing items achieved by methodical use of multiple divider devices and labels.

FIG. 9 shows an exemplary organized arrangement of clothing items achieved by a method of use of multiple divider devices 10 and labels. Multiple divider devices 10, each having a respective label applied, are mounted on and spaced along a clothing rod 5. Three devices 10 are shown with labels 8B, 8A, and 8D as a non-limiting example, thereby dividing space along the clothing rod into at least three sections 7, 8, and 9. The labels 8B, 8A, and 8D have been selected and applied to the divider devices 10 by a consumer intending to organize a closet in at least one example. Clothing groups 60, 70, and 80 are organized as pants 62, blouses 72, and winter clothing items 82, respectively, are each placed the right of the correspondingly labeled device 10, each in a respective section 7, 8, and 9. Each represented clothing item is shown on a respective hangar engaging the rod 5. The spacings represented by the sections 7, 8, and 9 between the dividers 10 can be changed to expand or reduce each clothing group by the addition or removal of corresponding clothing items.

Particular embodiments and features have been described with reference to the drawings. It is to be understood that these descriptions are not limited to any single embodiment or any particular set of features, and that similar embodiments and features may arise or modifications and additions may be made without departing from the scope of these descriptions and the spirit of the appended claims.

What is claimed:

1. A divider device for organizing hanging clothing items into groups by dividing space along a clothing rod into respective sections, the divider comprising:

a circularly arcuate clip having a terminal distal end, a proximal end, and an expansion joint, the clip defining a circularly arcuate internal contact surface for engaging the clothing rod and a gap between the distal end and the proximal end for permitting the clothing rod to pass therethrough by flexure of the clip when mounting the clip on the clothing rod, the internal contact surface being interrupted by at least the gap and thereby incompletely encircling a central axis of the circularly arcuate internal contact surface, wherein the clip is adapted to accommodate a range of clothing rod diameters through the expansion joint; and a planar presentation plate connected to the proximal end of the clip, the presentation plate being offset from the central axis and having a planar front face perpendicular to the central axis.

2. The divider device of claim 1, wherein the presentation plate is connected to the proximal end of the clip by an extension piece that supports the presentation plate when mounted on the clothing rod.

3. The divider device of claim 2, wherein the clip, the extension piece, and the presentation plate are materially contiguous.

4. The divider device of claim 1, wherein the presentation plate is offset from the central axis to be forward and elevated relative to a closet rod when mounted on the clothing rod.

5. The divider device of claim 1, wherein the expansion joint connects a circularly arcuate proximal section of the clip to a circularly arcuate distal section.

6. The divider device of claim 5, wherein the proximal section of the clip and the distal section of the clip each define a respective portion of the internal contact surface of the clip.

7. The divider device of claim 5, wherein the expansion joint comprises a first arm connected to the proximal section of the clip, a second arm connected to the distal section of the clip, and an elbow that connects the second arm to the first arm.

8. The divider device of claim 1, wherein the presentation plate comprises a front face that includes at least one of graphical indicia and text, the at least one of graphical indicia and text indicating a category of clothing items.

9. The divider device of claim 1, further comprising multiple adhesive-backed labels for user-selectively adhering to the presentation plate, each of the labels including at least one of graphical indicia and text, the at least one of graphical indicia and text of each label indicating a respective category of clothing items.

10. A method of organizing hanging clothing items into groups by dividing space along a into respective sections, the method comprising:

mounting multiple divider devices on a clothing rod and spaced along the clothing rod; and hanging clothing items in clothing category groups, each group adjacent a particular respective one of the multiple divider devices;

wherein each said divider device comprises:

a circularly arcuate clip having a terminal distal end, a proximal end, and an expansion joint, the clip defining an arcuate internal contact surface engaging the clothing rod and a gap between the distal end and the proximal end, the internal contact surface being interrupted by at least the gap and thereby incompletely encircling the closet rod; and a presentation plate connected to the proximal end of the clip, the presentation plate being offset from the closet rod and having a front face perpendicular to a longitudinal axis of the closet rod.

11. The method of claim 10, wherein the front face of the presentation plate of each particular divider device includes at least one of graphical indicia and text, the at least one of graphical indicia and text indicating the clothing category of the clothing category group adjacent the particular divider device.

12. The method of claim 10, wherein mounting multiple divider devices on the clothing rod comprises forcing the clip of each divider device onto the clothing rod by passing the closet rod through the gap of the clip.

13. The method of claim 12, wherein forcing the clip of each divider device onto the clothing rod comprises temporarily flexibly deforming the clip to pass the clothing rod through the gap until the clip snaps into engagement as the rod passes through the gap, and the clip returning toward an un-flexed condition.

14. The method of claim 13, wherein flexibly deforming the clip to pass the clothing rod through the gap comprises temporarily expanding the expansion joint.

15. The method of claim 14, wherein the expansion joint connects a circularly arcuate proximal section of the clip to a circularly arcuate distal section of the clip.

16. The divider device of claim 14, wherein the proximal section of the clip and the distal section of the clip each define a respective portion of the internal contact surface of the clip.

* * * * *